United States Patent [19]

Perkinson

[11] Patent Number: 5,067,559

[45] Date of Patent: Nov. 26, 1991

[54] DIFFUSER SCREEN FOR SPARGER NOZZLE

[75] Inventor: Seth Perkinson, Charlotte, N.C.

[73] Assignee: CDP Product Development Corporation, Mount Airy, Md.

[21] Appl. No.: 584,270

[22] Filed: Sep. 18, 1990

[51] Int. Cl.[5] ..... F28B 3/04

[52] U.S. Cl. ..... 165/112; 261/98; 261/DIG. 10; 60/688

[58] Field of Search ..... 165/110, 112; 261/DIG. 10, DIG. 32, 98; 60/688

[56] References Cited

U.S. PATENT DOCUMENTS 3,731,488 5/1973 Sasakura et al. ..... 165/110
4,296,802 10/1981 Larinoff ..... 165/110
4,301,861 11/1981 Larinoff ..... 165/110
4,759,315 7/1988 Chiou et al. ..... 261/DIG. 10

FOREIGN PATENT DOCUMENTS 9399 4/1933 Australia ..... 165/112
1051765 12/1966 United Kingdom ..... 261/DIG. 10

*Primary Examiner*—Albert W. Davis, Jr.
*Attorney, Agent, or Firm*—Ronald P. Kananen

[57] ABSTRACT

A method and apparatus for diffusing a liquid condensate return stream in an industrial steam condenser to reduce erosion and corrosion on the condenser structure. One or more diffuser screens are located intermediate a sparger nozzle and a condenser structure to diffuse the condensate screen prior to impact on the condenser structure.

11 Claims, 4 Drawing Sheets

DIFFUSER SCREEN FOR SPARGER NOZZLE

BACKGROUND OF THE INVENTION

This invention relates generally to a method and apparatus for diffusing a liquid condensate return stream in an industrial steam condenser to reduce erosion and corrosion on the condenser structure. More particularly, this invention relates to the use of one or more diffuser screens located intermediate a sparger nozzle and a condenser structure to diffuse the condensate stream prior to impact on the condenser structure. Still more particularly, this invention relates to a breaker screen and a diffuser screen of the type described for reducing erosion and corrosion on a condenser structure without compromising the heat transfer characteristics for which condensate is returned to a hot well in the condenser through sparger nozzles.

Steam generation systems for use in power plants, for example, are well known and highly developed. In general, such systems use a source of steam to drive a rotating machine, such as a turbine, to generate power in the form of electricity. The use of steam energy as a motive source removes energy from the steam resulting in a change of phase and the production of large amounts of condensate which travel from the turbine to a condenser. In large shell-and-tube steam condensers, the condensate is frequently pumped or gravitationally fed from various sources within the power plant to a hot well which is integral to the condenser. The hot well in the condenser serves as a reservoir for the condensate. The solid stream or streams of condensate are returned through a distribution pipe system or header arrangement to be discharged through several sparger nozzles into the condenser. For various structural and hydraulic reasons, the liquid returning to the hot well of a condenser is discharged from the spargers through sparger nozzles onto the hot well structural or functional components in great volumes and at high velocity. As a result, unwanted erosion of the condenser components results from the impingement of the rapidly moving water on those components.

In addition, a microscopic corrosion product particulate entrained in the liquid stream serves as an aggressive abrasive agent on the condenser components. Such product accelerates the erosion effect on the condenser structure. In order to alleviate these problems, many condenser manufacturers and owners have installed rigid metal baffle plates about the sparger nozzles to prevent erosion. Unfortunately, these added baffle plates have had only varying degrees of success. In certain condenser configurations, conventional solid metal baffles prove detrimental to the intended process. Occasionally, the water is deliberately sprayed onto the condenser tubes to achieve a further cooling of the fluid; however, the use of solid baffle plates can thus prevent the streams from striking the tubes and thus the desired heat transfer between the condensate return water from the sparger nozzles and the condenser tubes is adversely affected.

Occasionally, the water is introduced into the condenser in such a manner as to create a cascading or a deaerating effect inside the hot well of the condenser. In these types of structures, solid baffle plates may adversely affect the desired degree of diffusion to effect an adequate deaeration. Thus, it has remained a continuing problem in this art either to accept the adverse effects of corrosion caused by the discharge of corrosive return condensate liquid from sparger nozzles in fluid circuit with the sparger header in the condensate system, or to use metal baffle plates of the type described with the adverse affects noted, while relieving some of the adverse affects of the corrosion. Such engineering tradeoffs have not, as can be easily understood, been satisfactory.

Examples of systems for condensing turbine exhaust in power plants are shown in the U.S. Pat. Nos. 3,731,488; 4,296,802; and 4,301,861, while a representative example of sparger nozzles is shown in U.S. Pat. No. 4,322,384.

On the other hand, screens have been used for various reasons such as have been shown in U.S. Pat. Nos. 2,887,275; 3,173,614; and 4,119,276. Yet, no system has been developed which effectively uses diffuser screens located intermediate a sparger discharge nozzle and a portion of a condenser structure.

Accordingly, it is a principal object of this invention to provide a diffuser screen located intermediate a sparger nozzle for the discharge of condensate in a steam system to diffuse the fluid discharge, thus to reduce the eroding and corroding effects of the stream on the condensate.

It is another object of this invention to provide a method for diffusing fluid exiting from a sparger nozzle in a steam condensing system to reduce adverse effects of direct impingement of the liquid on the condenser structure.

It is an additional object of this invention to provide for the use of a plurality of screens located intermediate a sparger discharge nozzle and heat exchange structure in a condenser to sequentially diffuse the velocity of fluid flow of return condensate from the nozzle.

It is still an additional object of this invention to provide at least a pair of diffuser screens, at least one of which adjacent a sparger nozzle is mechanically energy absorbing, such as by movement of the screen upon fluid impact.

These and other objects of the invention will become apparent from the detailed description of the invention which follows, taken in conjunction with the accompanying drawings.

BRIEF SUMMARY OF THE INVENTION

Directed to achieving the foregoing objects and overcoming the problems in prior art steam generating systems, the invention relates to an apparatus for use intermediate a sparger nozzle connected to a sparger head in a steam condensing system and the heat exchange component of a condenser. The apparatus includes at least one diffuser screen located intermediate the nozzle in the heat exchange structure.

Preferably, at least a pair of such screens are used, wherein a screen adjacent the sparger nozzle is mechanically movable to absorb energy from the fluid upon impact. A suitable frame construction is also disclosed.

A method for diffusing condensate exiting from a sparger nozzle is also disclosed.

DETAILED DESCRIPTION OF THE PREFERRED EMBODIMENTS

Figure 1:
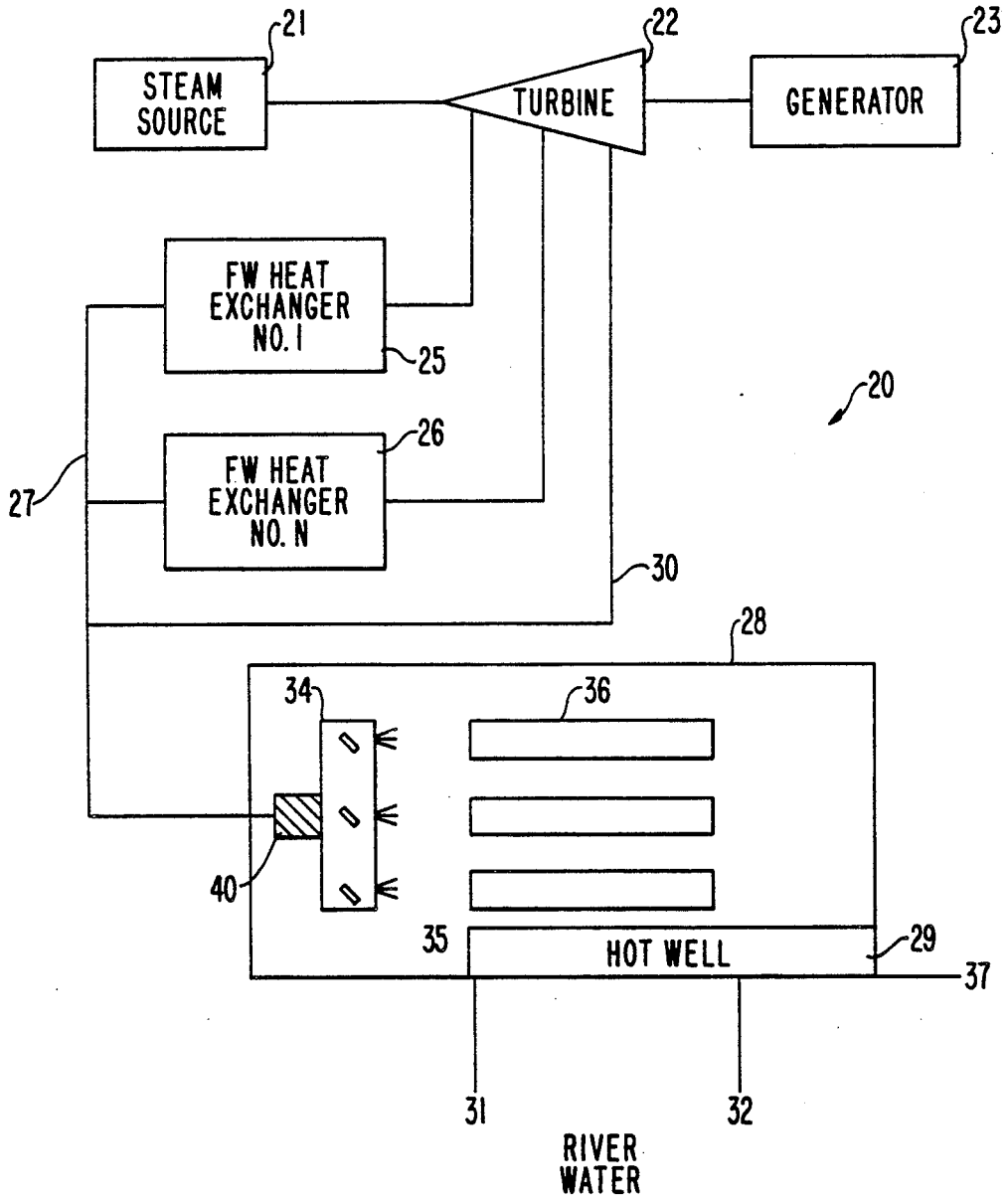
FIG. 1 is a block diagram of a conventional power generating system using a steam source and a condenser, to which the invention is applicable.

A power generating system to which the invention is applicable is shown in FIG. 1 and designated generally by the reference numeral 20. The system 20 includes a source of steam 21, such as a coal fired, nuclear, or oil-fired boiler, providing a source of steam to a rotating turbine 22 for driving a power generator 23 in a conventional manner. The spent steam from the turbine 22 is provided to a representative first feed water heat exchanger 25 and second feed water heat exchanger 26 to provide a source of condensate on a conduit 27 to a condenser 28 having a hot well 29. Additional feed water heat exchangers may also be used. Some condensate may also be directly provided to the condenser 28 through a conduit 30. The condenser 28 may use a cooling source such as river water circulated through the condenser 28 by way of an inlet conduit 31 and an outlet conduit 32.

The inlet conduits 27 and 30 to the condenser 28 may provide a source of condensate to a sparger nozzle 34 for providing a fluid spray 35 onto a plurality of heat exchange elements 36, such as tubes, in the condenser 28. The outlet from the condenser 28 may be provided on a conduit 37 to return to the steam source for recycling in a closed system, or otherwise disposed of, such as exiting to a water source.

The system shown in FIG. 1 is a conventional one which experiences the difficulties described earlier in this application. When a solid plate is inserted into such a system, it is generally located between the sparger nozzle 34 and the cooling tubes 36 so that the spray 35 impacts the baffle. Such a conventional solid metal baffle produced an inadequate dispersion, and cooling, and deaeration of the return stream. While such plates located as described reduce the fluid force of the sparger streams 35 on the tubes 36, the anchoring of the baffles to prevent their becoming loose parts within the condenser was often an extremely difficult task because all of the fluid stream energy must be dissipated onto the structural frame for the baffle. Moreover, such a solid baffle simply transfers the erosion and corrosion problems of the condensate to the baffles themselves so that the baffles then become in effect sacrificial shields suffering from early disintegration into disassociated fragments, adding to the loose components problem in the condenser 28.

At the heart of this invention is first the notion that the use of one or more water penetratable diffuser screen mounted in frames intermediate the sparger sprays 35 and the cooling tubes 36 would provide significant advantages, and second that at least the screen closest to the sparger nozzle is flexible to absorb impact energy mechanically. The porous plates reduce fluid stream velocity, thus allowing the return fluid to be gently introduced as a finely divided series of small, low velocity streams spraying onto the condenser tubes 36 or other internal components of the condenser 28. A superior diffusion of the spray 35 provides a better separation of the non-condensable gases, thus optimizing deaeration. In addition diffusion and the resulting velocity loss predispose metal and oxide corrosion products to precipitate from the fluid intersticially to the several screens, thus dramatically reducing the particle impingement component of the erosion phenomenon. By producing a labyrinthian multidirectional fluid, the excess energy is dissipated by a resilient medium specifically designed to absorb the energy of the fluid in an innocuous manner. The supports and frames of the diffuser screens according to the invention are designed for easy incremental assembly inside or within existing condensers 28.

Figure 2:
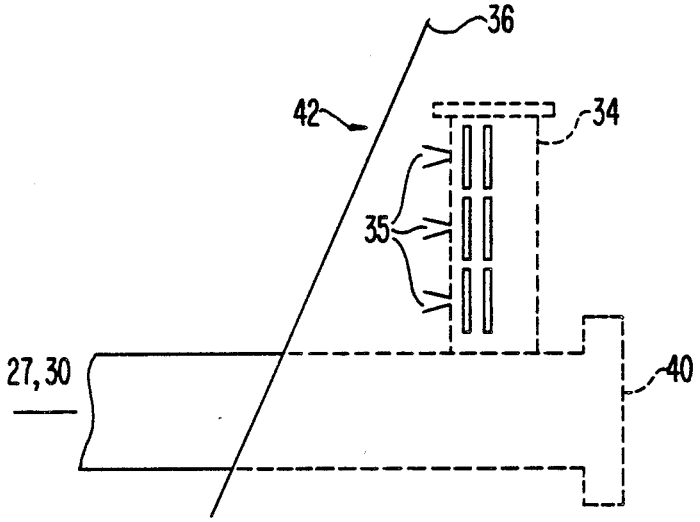
FIG. 2 (PRIOR ART)
FIG. 2 is a top view of a typical sparger header and sparger nozzle arrangement emitting condensate against a condenser wall causing erosion and corrosion.

FIG. 2 shows in greater detail an up-comer sparger header 40, receiving condensate from the conduits 27, 30 connecting to a sparger discharge nozzle 34 as shown in FIG. 1. The sparger nozzle 34 discharges the spray 35 directly onto the condenser or hot well wall 36 producing erosive wear indicated by the irregular lines 42. While the arrangement shown is typical, the cooling water tube sheet could have approximately the same general orientation with the sparger nozzle 34 and the orientation of the nozzle relative to the tube sheet is not critical to the invention.

Figure 3:
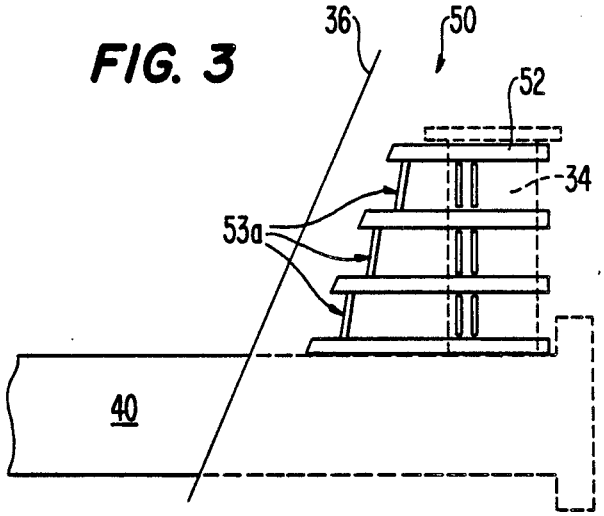
FIG. 3 is a top view of the apparatus according to the invention showing the positioning of a diffuser screen intermediate the sparger nozzle and condenser wall, as supported by a diffuser frame support structure.

A diffuser screen according to the invention is shown in FIG. 3 and designated generally by the reference numeral 50 for diffusing the condensate spray 35 from the sparger nozzle 34. More specifically, a diffuser frame support designated generally by the reference numeral 52 comprises a plurality of diffuser frame support members 52*a* . . . 52*d* having a plurality of diffuser screens 53*a*, 53*b* and 53*c* interposed between the frame supports 52*a* through 52*d*, respectively. The diffuser screens, when so positioned, diffuse the spray 35, to achieve the advantages described.

Figure 4:
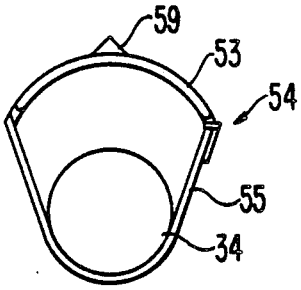
FIG. 4 is a top view of a sparger nozzle with the diffuser frame attached.

FIG. 4 shows a top view of the sparger nozzle 34 with a diffuser screen 53 secured to a support member 55 by fastening means 54. The support member 55 incorporates a heavy structural steel member made from a grade of steel or alloy which is compatible with the material of construction of the hot well 36 and the components in the condenser 28. The support member 55 is of a sufficient size and strength to provide a total restraint for several similar resilient diffuser frames. Preferably, the support is arranged to contain three or more tiers of diffuser frames, wherein the lowest tier is the largest and each higher successive tier is smaller than the immediate lower one. As shown, an elongated an support angle member 59 is located about at the midpart of the screen 53 for structural support. However, the particular details of attachment of the screen are depended upon the particular installation to which the invention applies.

As seen in FIG. 4, each tier of the diffuser screen 53 is arranged as an arc of approximately one radian, the radius of the highest screen being one diameter of a sparger nozzle 34, the discharge 35 of which is to be diffused. Each diffuser screen 53 is slightly slanted inwardly at the top, effecting an appearance as an arc section of a frustum. Any tier may be disassembled for maintenance without removal of the adjoining frames.

Figure 5:
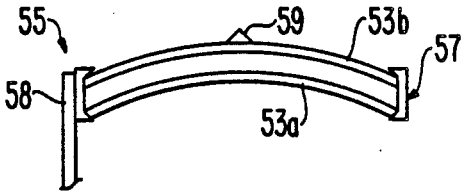
FIG. 5 is a cross-sectional view of the diffuser frame showing a connector bar, a supporter angle, and a channel frame relative to a breaker screen and a diffuser screen.
Figure 6:
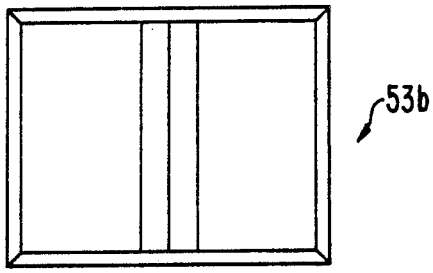
FIG. 6 is a front view of a diffuser frame used in the invention.
Figure 7:
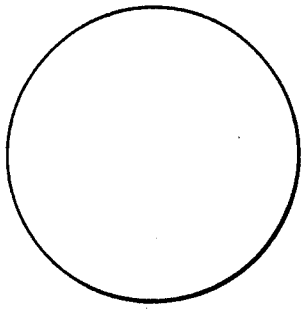
FIG. 7 is a magnified view of a cross-section of a portion of the diffuser screen of FIG. 6.

FIG. 5 shows a cross-section of the diffuser frame 55 wherein the frame itself is made up of a two inch channel frame member 57 at the ends of the arc shaped screen 53 connected at one end to a connecting bar 58. The support angle 59 is provided approximately at the midpoint of the diffuser screen 53.

As shown in FIG. 5, it is preferred that each diffuser frame 57 be fabricated of two or more diffuser screens 53*a* and 3*b*, wherein the screen nearer to the sparger nozzle 55 is a breaker screen 53*b* and the screen most remote from the sparger nozzle 55 is a diffuser screen 53*a*. The breaker screen 53*a* receives the initial thrust of the stream 35 from the sparger nozzle 34 to be diffused while the diffuser stream 53 provides a rigid labyrinthian passage which reduces the water into a fine spray.

Figure 8:
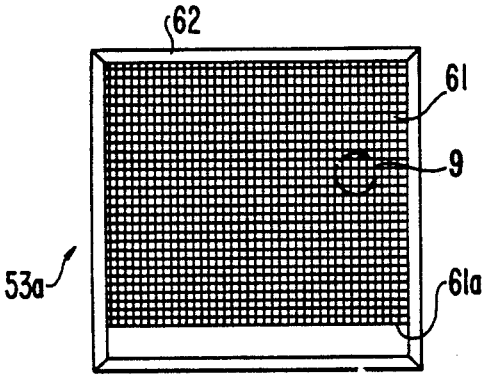
FIG. 8 is a frontal view of a breaker screen of FIG. 5.
Figure 9:
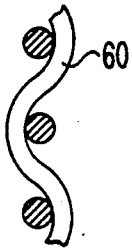
FIG. 9 is a view of a portion of the breaker screen of FIG. 8.

More particularly, the breaker screen 53*a*, as shown in FIG. 8 and in magnified view in FIG. 9, is fabricated of a very heavy wire 60, for example of an American standard gauge (AWG) 10 to as coarse as AWG 6, with a weave of about ¼ inch or ½ inch mesh. The woven wire panel 61 is firmly held by mechanical capture and welds in the screen frame 62 secured to the channel frame 57 on the top and on both sides. The bottom side 61*a* of the screen 61 is freely movable to allow a maximum resilience of the screen panel 61 to dissipate the initial impact energy of the discharged water from the sparger nozzle 34. In installations where very high pressures are encountered, it may be necessary to install a primary and a secondary breaker screen. In such installations, all three screens would preferably lie equidistantly apart in a common channel frame 57, wherein the secondary breaker screen would be of a finer mesh and slightly varied orientation of weave from the primary breaker screen 53*a* to maximize depressurization and diffusion of the stream from the sparger nozzle 34.

The diffuser screen 53*b* is fitted into the same screen frame 57 as the breaker screens 53*a* and the respective screens are spaced apart between about one inch and several inches. The spacing depends upon the pressure and volume of the stream from the sparger nozzle 34, wherein the physical dimensions of the given sparger nozzle 34 and the overall hot well design influence the spacing. The diffuser screen is preferably made of a patented integrally sintered fabricated surface barrier filter material, incorporating five laminations of variously woven and patterned stainless steel wire screens, commercially available from Fuji America under the trademark "FUJIPLATE". The diffuser screen 53(*b*) is firmly anchored to the diffuser frame 57 on all four sides and preferably has a mesh on the order of 240 microns to about 500 microns. The fine mesh of the diffuser screen 53*b* breaks the stream 35 from the sparger nozzle 34 into a fine mist, harmless to the condenser internal structures.

The diffuser screen 53*b* cannot pass the full volume of fluid and there is a refraction of some of the water back toward the breaker screen 53*a*. This retrograde movement of a small portion of the fluid further attenuates the force of the water hitting the diffuser screen 53*b* and at the same time causes some counter force against the breaker screen 53*a*, thereby counter balancing the thrust of the influent on the breaker screen. Much of the refractive flow falls harmlessly back into pool water in the hot well of the condenser.

The above described multi-directional movements of the several divided water streams effects a harmless energy distribution, one stream against another, in such a manner that the net energy to be absorbed by the several screens in their structural supports is marketed reduced.

Figure 10:
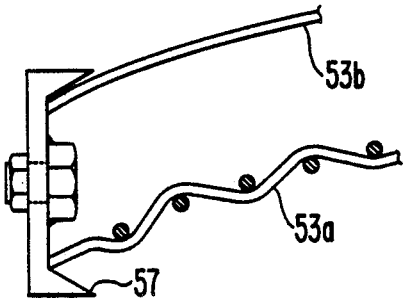
FIG. 10 is a more detailed view of the end of the screen frame securing the breaker screen and the diffuser screen.
Figure 11:
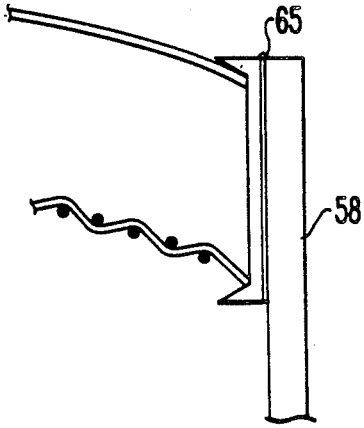
FIG. 11 is a top view of the structure of FIG. 10.
Figure 12:
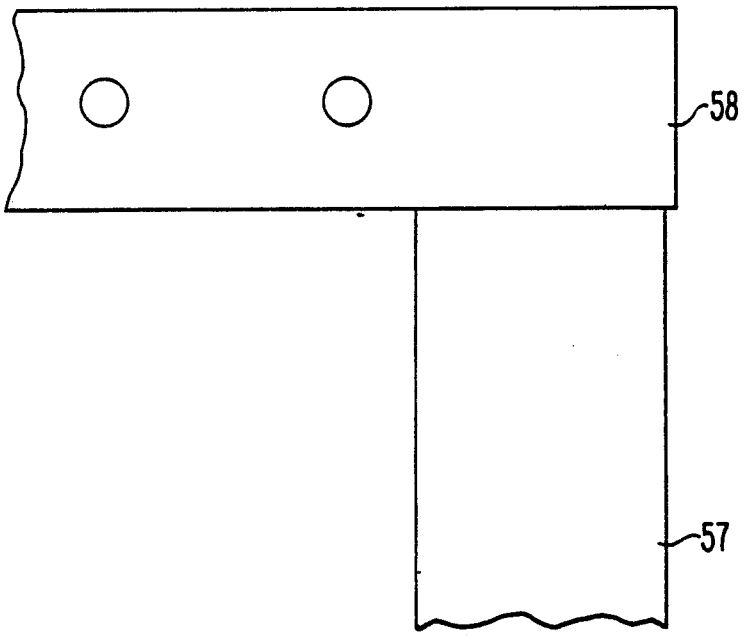
FIG. 12 is a side view of the structure of FIGS. 10 and 11.
Figure 13:
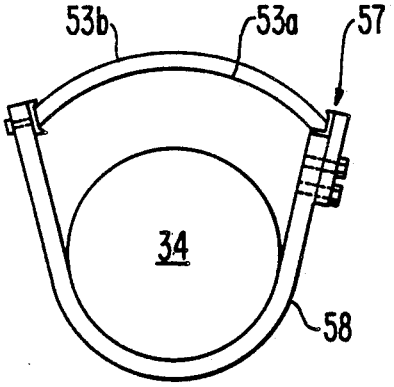
FIG. 13 is a more detailed view of a screen secured to a supporting structure relative to a sparger nozzle.
Figure 14:
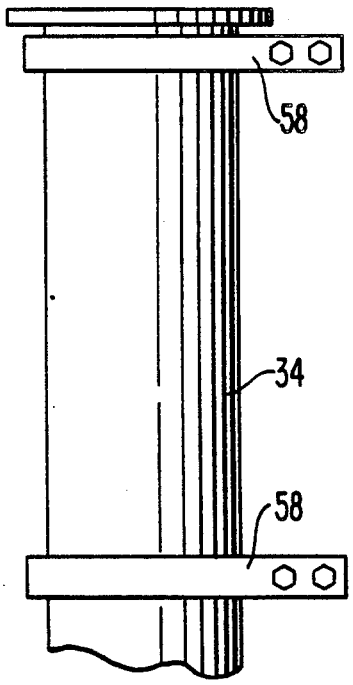
FIG. 14 is a top view of the diffuser frame supports on a sparger nozzle.

By way of description of the best mode currently contemplated by the inventor for practicing the invention, FIGS. 10–12 describe in further detail the connection of a screen frame having a channel frame 57 secured to a connecting bar 58 by welding, such as is shown by the weldment 65. FIGS. 13 and 14 show top views of the assembly of FIGS. 10–12 secured to the sparger nozzle 34.

Thus, a method and apparatus for diffusing a liquid condensate return stream in an industrial steam condenser to reduce erosion and corrosion on the condenser structure is shown and described.

What is claimed is:

1. An apparatus for diffusing a fluid stream, comprising:

a source of fluid for directing a stream of said fluid in a first direction;

a target for receiving said stream of said fluid upstream of said source in said first direction; and means interposed between said source and said target for diffusing said stream, said diffusing means comprising a screen having a plurality of openings therein for dispersing said stream, said source of fluid being a sparger nozzle, said target being a component of a condenser in a steam generating unit.

2. The apparatus as set forth in claim 1 wherein said diffusing means comprises a first breaker screen having a plurality of larger openings therein for dispersing said stream, said breaker screen being located nearest said sparger nozzle, and a diffuser screen spaced in said first downstream of said breaker screen in said first direction, said diffuser screen having a finer mesh, thus defining openings smaller than said plurality of larger openings in said breaker screen.

3. The apparatus as set forth in claim 2 further including a frame for said diffuser screen and said breaker screen, said frame being structurally adapted to connect to said sparger nozzle to fix said breaker screen and said diffuser screen relative to said sparge nozzle.

4. The apparatus as set forth in claim 3 further including a connecting bar located approximately intermediate a face of said diffuser screen for strengthening said diffuser screen, said connecting bar being an elongated channel member.

5. The apparatus as set forth in claim 2, wherein said breaker screen is mechanically movable in part upon the initial impact of said discharge stream, thus to absorb mechanically the impact of said stream.

6. The apparatus as set forth in claim 1, wherein said diffusing means acts to reduce fluid stream velocity to cause the fluid to be introduced to said target as a finely divided series of small low velocity streams.

7. The apparatus as set forth in claim 1, wherein said diffusing means comprises a plurality of diffuser frames and a diffuser frame support comprising a plurality of diffuser frame support members for supporting a plurality of diffuser screens.

8. The apparatus as set forth in claim 1, wherein the screen is made from an integrally centered fabricated surface barrier filter material having a plurality of laminations of variously woven and patterned stainless steel wire screens.

9. The apparatus as set forth in claim 8, wherein said screen preferably has a mesh on the order of 240 microns to about 500 microns.

10. A method for diffusing a fluid stream in a steam generating system comprising:

providing a source of condensate from a sparger nozzle in the form of a spray directed in a first direction; and diffusing said spray by a diffuser screen interposed between said sparger nozzle and a portion of a condenser in said steam generation system.

11. The method as set forth in claim 10, wherein the step of diffusing comprises the step of diffusing said stream with a break away screen having a plurality of large openings therein and a diffuser screen spaced therefrom having a plurality of relatively small openings therein.

* * * * *